US008931267B2

(12) United States Patent
Gill

(10) Patent No.: US 8,931,267 B2
(45) Date of Patent: Jan. 13, 2015

(54) PUMPS

(75) Inventor: Simon David Gill, Bristol (GB)

(73) Assignee: Vetco Gray Controls Limited, Bristol (GB)

( * ) Notice: Subject to any disclaimer, the term of this patent is extended or adjusted under 35 U.S.C. 154(b) by 695 days.

(21) Appl. No.: 13/146,306

(22) PCT Filed: Dec. 10, 2009

(86) PCT No.: PCT/GB2009/051683

§ 371 (c)(1),
(2), (4) Date: Jul. 26, 2011

(87) PCT Pub. No.: WO2010/086580

PCT Pub. Date: Aug. 5, 2010

(65) Prior Publication Data

US 2011/0277458 A1 Nov. 17, 2011

(30) Foreign Application Priority Data

Jan. 29, 2009 (GB) ..... 0901432.5

(51) Int. Cl.

| | |
|---|---|
| ***F16D 31/02*** | (2006.01) |
| ***E21B 41/00*** | (2006.01) |
| ***F04B 5/02*** | (2006.01) |
| ***F04B 9/109*** | (2006.01) |
| ***F04B 9/117*** | (2006.01) |

(52) U.S. Cl.

CPC ..... *E21B 41/005* (2013.01); *F04B 5/02* (2013.01); *F04B 9/109* (2013.01); *F04B 9/117* (2013.01)

USPC ..... 60/461; 60/418

(58) Field of Classification Search

USPC ..... 60/418, 419, 420, 461; 417/401, 402, 417/403, 404

See application file for complete search history.

(56) References Cited

U.S. PATENT DOCUMENTS

| | | | | |
|---|---|---|---|---|
| 3,145,995 | A | 8/1964 | Bliss et al. | |
| 6,105,670 | A | 8/2000 | Klos et al. | |
| 2006/0201678 | A1 * | 9/2006 | Judge et al. | 166/335 |

FOREIGN PATENT DOCUMENTS

| | | | |
|---|---|---|---|
| CN | 1450246 | A | 10/2003 |
| CN | 101201003 | A | 6/2008 |
| EP | 0568742 | A1 | 11/1993 |
| GB | 1316381 | A | 5/1973 |
| GB | 2108593 | A | 5/1983 |
| GB | 2327958 | A | 2/1999 |
| GB | 2356432 | A | 5/2001 |
| GB | 2465168 | A | 5/2010 |
| WO | 0138648 | A1 | 5/2001 |
| WO | 2006027562 | A1 | 3/2006 |

OTHER PUBLICATIONS

WO Search Report issued in connection with International Application No. PCT/GB2009/051683, on Jul. 21, 2010.

GB Office Action issued in connection with GB Application No. 0901432.5 on Jun. 1, 2009.

Unofficial English translation of CN Office Action dated Dec. 4, 2013 from corresponding Application No. 200980156018.8.

* cited by examiner

*Primary Examiner* — Edward Look
*Assistant Examiner* — Daniel Collins
(74) *Attorney, Agent, or Firm* — GE Global Patent Operation

(57) ABSTRACT

A pump for use in pumping hydraulic well control fluid expelled from a control device of a well, comprises means for accumulating such hydraulic well control fluid and means for using the pressure of hydraulic fluid supplied to the well to pump accumulated hydraulic well control fluid into a production flowline of the well.

20 Claims, 4 Drawing Sheets

PUMPS

CROSS REFERENCE TO RELATED APPLICATIONS

This is a national stage application under 35 U.S.C. §371 (c) of prior-filed, co-pending PCT patent application serial number PCT/GB2009/051683, filed on Dec. 10, 2009, which claims priority to British patent application serial number 0901432.5, filed on Jan. 29, 2009, each of which is hereby incorporated by reference in its entirety.

BACKGROUND OF THE INVENTION

1. Field of the Invention

Embodiments of the present invention relate to pumps, in particular to pumps for pumping hydraulic well control fluid into a production flowline of a well.

2. Description of the Prior Art

During the operation of a subsea well, hydraulic fluid is expelled from hydraulic control actuating devices, such as valve and choke actuators. Typically, in the past, this fluid has been exhausted to the sea. The fluid is, typically, ethylene glycol based and is now considered to be a pollutant. Environmental legislation now prompts well operators to stop exhausting such fluids into the sea, particularly on new installations, which presents well equipment suppliers with the problem of finding a solution to the new requirements. GB Patent Application No. 0820326.7 discloses a method of disposing of hydraulic well control fluid, comprising pumping the fluid into a production flowline of the well. Although it is possible to effect such a method with an electrically powered pump, a failure of electric power would not allow hydraulic fluid to continue to be exhausted from actuators during the well shut down. Embodiments of the present invention enables a pump that provides the necessary pressure to inject exhausted hydraulic fluid into the production flowline, handles the fluid exhausted during a well shut down and does not need electric power.

BRIEF SUMMARY OF THE INVENTION

According to an embodiment of the present invention, there is provided a pump for use in pumping hydraulic well control fluid expelled from a control device of a well, comprising means for accumulating such hydraulic well control fluid and means for using the pressure of hydraulic fluid supplied to the well to pump accumulated hydraulic well control fluid into a production flowline of the well.

Preferably, said accumulating means comprises a cylinder arrangement including a piston, accumulated hydraulic well control fluid acting at one side of the piston for displacing the piston in a first direction, said means for using the pressure of hydraulic fluid supplied to the well applying pressure at the opposite side of said piston.

According to an embodiment of the present invention, there is provided a pump for pumping hydraulic well control fluid expelled from a hydraulic control device of a well into a production flowline of the well, comprising: a first cylinder arrangement, for accumulating such hydraulic well control fluid via a first inlet to the first cylinder arrangement; a piston in the first cylinder arrangement, expelled well control fluid being accumulated on one side of the piston; a second cylinder arrangement containing hydraulic fluid and in fluid communication with the first cylinder arrangement on the opposite side of the piston, wherein the pressure of expelled fluid accumulating in the first cylinder arrangement can cause said piston to be displaced in a direction towards the second cylinder arrangement, there being means for accommodating the displacement of hydraulic fluid in the second cylinder arrangement; and a further inlet to the first cylinder arrangement on the opposite side of said piston for receiving hydraulic fluid supplied to the well, there being an outlet from the first cylinder arrangement on said first side of the piston for communicating with a production flowline of the well, the pump being such that if said piston has been displaced toward said second cylinder arrangement and if hydraulic fluid is applied to said further inlet at a pressure greater than the pressure of accumulated well control fluid in the first cylinder arrangement, said piston is displaced in a direction away from the second cylinder arrangement to displace accumulated well control fluid out of the first cylinder arrangement via said outlet.

There could be displacement means (such as a spool) received by said first cylinder arrangement between said piston and said further inlet, there being urging means (such as spring means in said second cylinder arrangement) for urging said displacement means in a direction towards the second cylinder arrangement, hydraulic fluid at said further inlet acting on said displacement means so that, if the pressure of hydraulic fluid at said further inlet is greater than pressure of accumulated well control fluid, said displacement means is displaced against the action of said urging means to displace said piston.

Each of said first inlet and said outlet is preferably provided with a one-way valve for permitting flow into and out of said first cylinder arrangement respectively.

Said second cylinder arrangement could comprise a first cylinder in fluid communication with said first cylinder arrangement and a second cylinder in fluid communication with said first cylinder, there being a further piston in said second cylinder, said accommodating means being in fluid communication with the side of said further piston remote from said first cylinder.

Said accommodating means could comprise an expandable container.

The pump could include means for sensing pressure of accumulated expelled hydraulic well control fluid to produce an indication for use in increasing the pressure of hydraulic fluid at said further inlet in response to the pressure of accumulated expelled hydraulic well control fluid reaching a particular value.

According to an embodiment of the present invention, there is provided a method of pumping hydraulic well control fluid expelled from a control device of a well, comprising accumulating such hydraulic well control fluid and using the pressure of hydraulic fluid supplied to the well to pump accumulated hydraulic well control fluid into a production flowline of the well.

In an embodiment of the present invention, hydraulic power is supplied to a subsea well, typically from a surface source, via an umbilical, at a pressure of 280 bar. This is considerably less than the maximum pressure that the hydraulic system is able to handle. The pump to be described utilises a step increase, typically to 345 bar, of the hydraulic pressure fed to the well, to provide power to operate the pump, such that neither electric power nor a separate hydraulic power source is required. The pump also incorporates a storage system, adequate to contain the expelled fluid during a well shut down, which could result from electrical and/or hydraulic power failure, which is emptied on restoration of hydraulic power. Furthermore no hydraulic fluid is exhausted from the hydraulic operating mechanism of the pump, as the fluid is recycled.

DETAILED DESCRIPTION OF THE INVENTION

Figure 1:
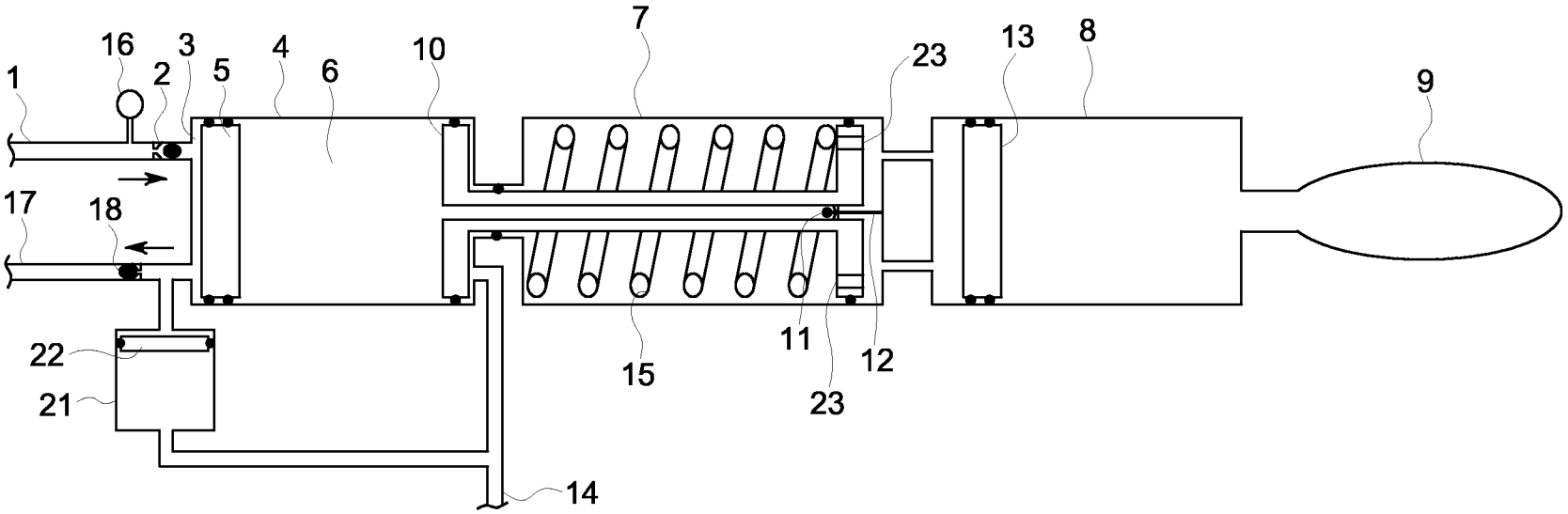
FIG. 1 shows a pump according to an embodiment of the invention in a quiescent state.

Referring first to FIG. 1, which is a diagrammatic sectioned view of a pump in its quiescent position, i.e. ready to accept exhausted or expelled hydraulic fluid, an inlet port 1 is connected to the combined exhaust hydraulic control fluid outlets from hydraulic devices on a subsea well, such valve and choke actuators. When one or more hydraulic devices exhausts fluid, it passes via a non-return valve 2 into a void 3 within a cylinder 4 to be accumulated therein and push a free running piston 5 to the right in the figure. A void 6 within the cylinder 4 is filled with hydraulic fluid and is the same fluid that fills cylinders 7 and 8 and a bladder 9. The movement of the piston 5 forces hydraulic fluid in the void 6 to pass through an orifice in the centre of displacement means in the form of a spool 10 (whose left-hand end in the figure is received in the cylinder 4) and into the cylinder 7 via a non-return valve 11, which is normally be closed for a flow in this direction, but is held open by a spigot 12. Fluid flow through the spool 10 forces a tree running piston 13 in the cylinder 8 to move to the right in the figure, thereby forcing hydraulic fluid into the bladder 9, which expands appropriately.

The pump is fed with power by hydraulic fluid from the existing well hydraulic supply via a second inlet port 14 communicating with an umbilical of the well, to act upon the face of the spool 10 in the cylinder 4 and tends to push the spool 10 to the left in the figure. However, this is resisted by urging means in the form of a spring 15 in cylinder 7, whose compression force is adjusted to match the force applied by the well hydraulic power source. Thus, the spool 10 remains in position to the right in the figure, the spring compression being just enough to retain the spool 10 over the tolerance range of the normal operating pressure of the well hydraulic power source.

Figure 2:
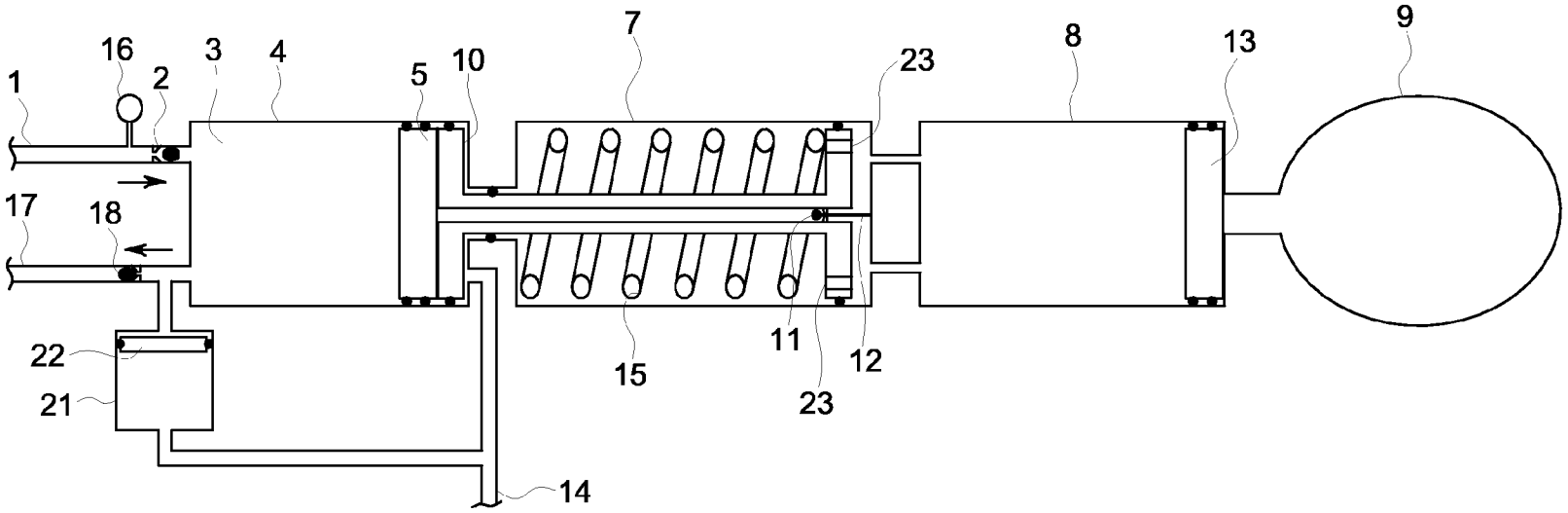
FIG. 2 shows the pump having accumulated expelled hydraulic control fluid according to an embodiment of the present invention.

The void 3 is thus a storage or accumulation space for expelled hydraulic fluid from the operation of well control hydraulic devices, resulting in the piston 5 eventually moving as far to the right in the figure as it can, being stopped by the left-hand face in the figure of the spool 10, and fluid in the cylinder 8 being displaced into the bladder 9. This state is illustrated in FIG. 2. Further expelling or exhausting of hydraulic fluid into the inlet port 1 results in a rise in this inlet pressure, which is sensed by a pressure switch 16. Such a pressure switch 16 normally exists already on well hydraulic fluid exhaust systems and is connected electrically, via the well umbilical, to the well control centre at the surface, or on land, where the well hydraulic power source is also located. On receipt of a signal from the pressure switch, the control system step increases the hydraulic pressure at inlet port 14 from the source, i.e. typically, for example, from 280 bar to 345 bar.

Figure 3:
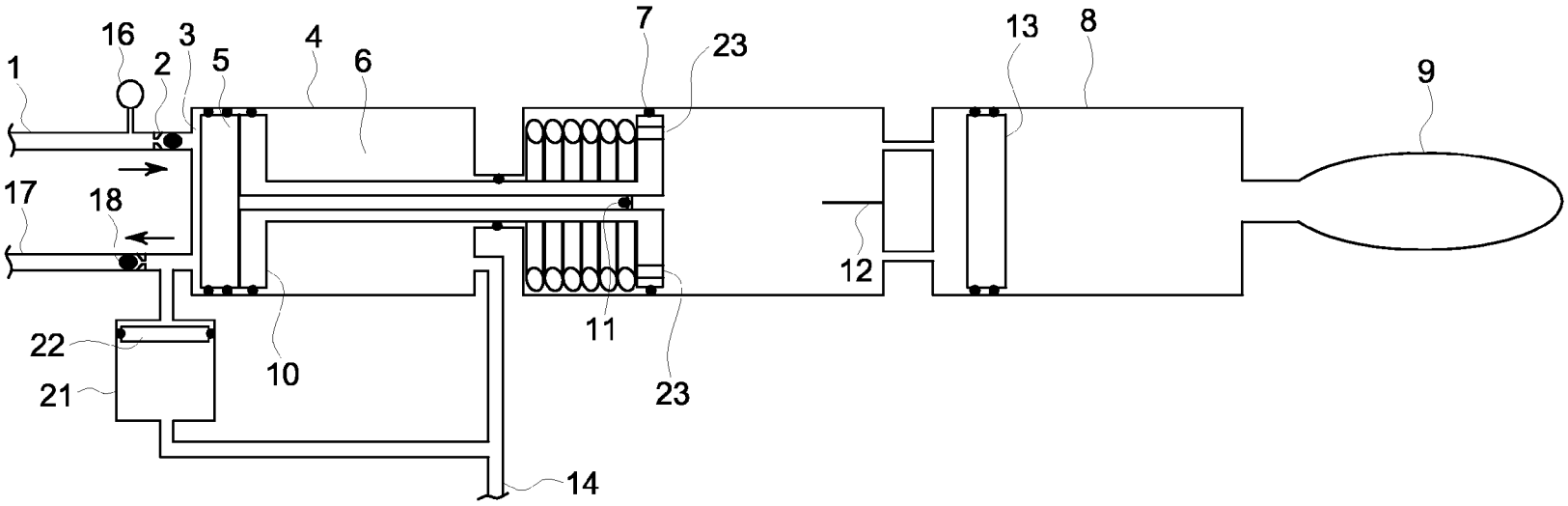
FIG. 3 shows the pump having pumped accumulated hydraulic control fluid into a production flowline of the well according to an embodiment of the present invention.

FIG. 3 illustrates the result of this increased pressure, via, the inlet port 14, acting on the right-hand face is the figure of the spool 10, producing a force greater than that applied by the spring 15, resulting in the spool 10 moving to the left in the figure and closing of the valve 11, since it is moved away from the spigot 12, and an increase of the pressure of the exhausted hydraulic fluid in the void 3 in the cylinder 4. An outlet port 17 of the pump houses a non-return valve 18 and is connected, via a pressure release valve, to an injection nozzle in the well production fluid flowline. The increase in pressure in the void 3 closes the inlet non-return valve 2, and when greater than the pressure in the production fluid flowline, opens the non return valve 18, allowing accumulated fluid in the void 3 to be disposed of by injection into the production fluid flowline, and resetting the pump to the quiescent state of FIG. 1.

If there is a failure of the hydraulic power supply fed to the inlet port 14, when the cylinder 4 is full of expelled hydraulic fluid, more hydraulic fluid will be available at the inlet port 1. This is able to enter an overflow cylinder 21, depressing a piston 22. The volume of the cylinder 21 is designed to be sufficient to handle all expelled hydraulic fluid resulting from a well shut down. On restoration of the hydraulic pressure at the inlet 14, the pressure switch 16 operates at the first exhaust of hydraulic fluid via the inlet 1, resulting in operation of the empty cycle by a step increase of pressure at the inlet 14. Reference numerals 23 designate holes which perforate the right-hand side in the figures of spool 10 to allow free movement of hydraulic fluid in the cylinder 7.

Figure 4:
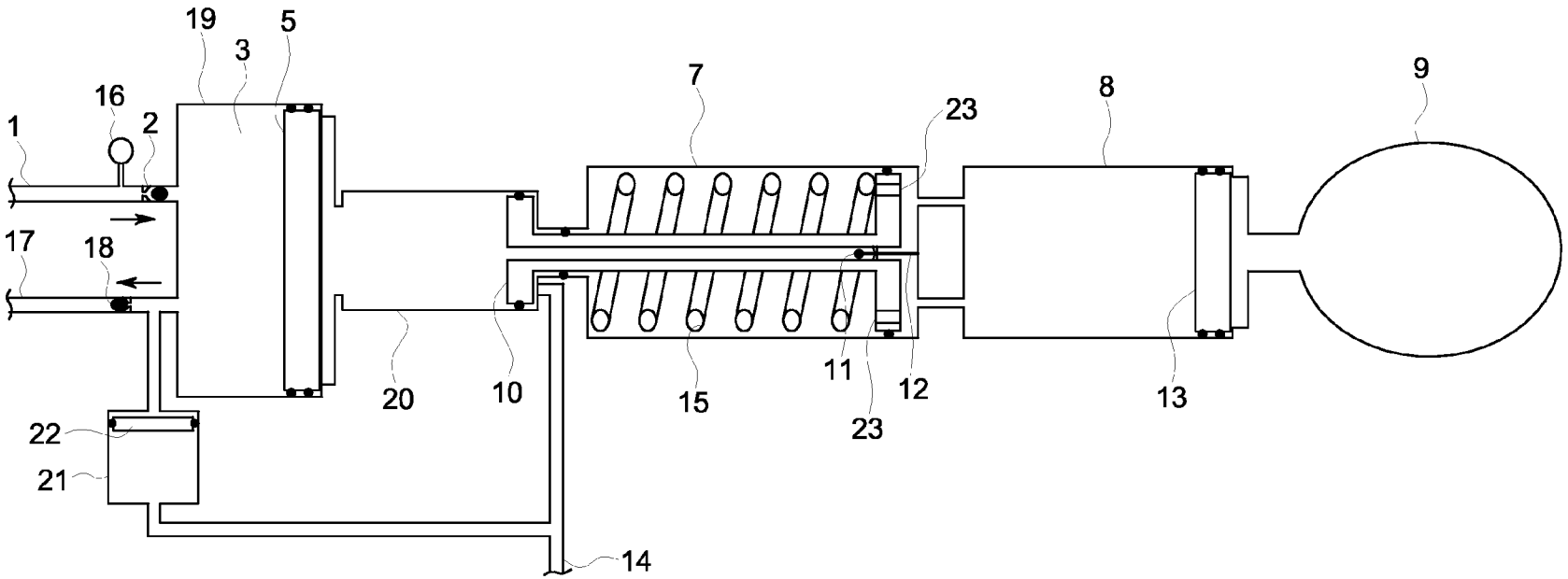
FIG. 4 shows an alternative pump construction in the condition of having accumulated expelled hydraulic control fluid according to an embodiment of the present invention.

The maximum pressure that can be generated in the void 3 is approximately equal to the increase in hydraulic source pressure at the inlet port 14, when the internal diameter of the cylinder 4 is constant, and will be adequate to inject fluid into a production flowline whose pressure is less than this. Thus, the available pressure would be 345 bar−280 bar=65 bar approximately. If the production flowline pressure is greater than this, the cylinder 4 could be replaced by two cylinders 19 and 20 as illustrated in FIG. 4. The ratio of the internal diameters of the cylinders 19 and 20 determines the final available pressure at the outlet 17. Thus, in the example, the outlet pressure will be 65 bar×(diameter of cylinder 19/diameter of cylinder 20). The pump can therefore be designed either to handle the maximum known production flowline pressure or to suit a particular application. In practice, the ratio of the internal diameters of the cylinders 19 and 20 will have to be substantially greater than that simply calculated, as above, since the available force is reduced as the spring 15 compresses.

It should be noted that the cylinder 8 and its free running piston 13 are not essential components of this pump, since it will function correctly with the output of the cylinder 7 connected directly to the bladder 9. However, well operators prefer double isolation of a pump core from the external environment and, since the bladder provides only a single level of isolation from the environment, the cylinder 8 and piston 13 are included to provide a desired second level of isolation. Also, spring 15 could be replaced, for example, by the use of hydraulic pressure for urging spool 10 in a direction to the right in the figures.

The key advantage of the pump is that it does not require a separate source of power, and operates from a step increase of pressure from the existing well hydraulic power source. Further advantages are a) the hydraulic fluid used by the pump is not expelled or exhausted, but recycled back to its source when the step increase of pressure is reduced to normal operating pressure and b) exhausted or expelled hydraulic fluid from well actuators for example, resulting from a well electric and/or hydraulic power failure, is accommodated by the pump and disposed of by injection into the production flowline when hydraulic power is restored.

The invention claimed is:

1. A pump for pumping hydraulic well control fluid expelled from a control device of a well, the pump comprising:

a cylinder arrangement configured to accumulate the expelled hydraulic well control fluid;

a mechanism configured to use the pressure of hydraulic fluid supplied to the well to pump accumulated expelled hydraulic well control fluid into a production flowline of the well and a sensor configured to sense a pressure of accumulated expelled hydraulic well control fluid to produce an indication for use in increasing a pressure of hydraulic fluid at the second inlet in response to the pressure of accumulated expelled hydraulic well control fluid reaching a predetermined value.

2. The pump according to claim 1, wherein the cylinder arrangement comprises:

a piston, wherein the accumulated expelled hydraulic well control fluid acts at a first side of the piston for displacing the piston in a first direction.

3. A pump for pumping hydraulic well control fluid expelled from a hydraulic control device of a well into a production flowline of the well, the pump comprising:

a first cylinder arrangement configured to accumulate the expelled hydraulic well control fluid via a first inlet to the first cylinder arrangement, the first cylinder arrangement comprising:

a piston, wherein the expelled hydraulic well control fluid is accumulated on a first side of the piston;

a second inlet on a second side of the piston, the second inlet configured to receive hydraulic fluid supplied to the well:

an outlet on the first side of the piston in fluid communication with a production flowline of the well;

a second cylinder arrangement positioned on the opposite side of the piston, the second cylinder arrangement containing hydraulic fluid and in fluid communication with the first cylinder arrangement, wherein the pressure of the expelled hydraulic well control fluid accumulated in the first cylinder arrangement displaces the piston in a direction towards the second cylinder arrangement; and an expandable container configured to accommodate the displacement of hydraulic fluid in the second cylinder arrangement, wherein if the piston has been displaced in the direction toward the second cylinder arrangement and the hydraulic fluid is applied at the second inlet at a pressure greater than the pressure of accumulated expelled well control fluid in the first cylinder arrangement, the piston is displaced in a direction away from the second cylinder arrangement and the accumulated expelled well control fluid is displaced out of the first cylinder arrangement via the outlet.

4. The pump of claim 3, further comprising:

a spool positioned between the piston and the second inlet; and a spring positioned in the second cylinder arrangement configured to urge the spool in the direction towards the second cylinder arrangement, wherein hydraulic fluid at the second inlet acts on the spool so that if the pressure of hydraulic fluid at the second inlet is greater than the pressure of accumulated expelled well control fluid, the spool is displaced against the action of the spring to displace the piston in the direction away from the second cylinder arrangement.

5. The pump of claim 3, wherein each of the first inlet and the outlet is provided with a one-way valve for permitting flow into and out of the first cylinder arrangement respectively.

6. The pump of claim 3, wherein the second cylinder arrangement comprises:

a first cylinder in fluid communication with the first cylinder arrangement and a second cylinder in fluid communication with the first cylinder; and a second piston positioned in the second cylinder, wherein the expandable container is in fluid communication with the side of the second piston remote from the first cylinder.

7. The pump of claim 3, further comprising a pressure sensor configured to sense the pressure of accumulated expelled hydraulic well control fluid and to produce an indication for use in increasing the pressure of hydraulic fluid at the second inlet in response to the pressure of accumulated expelled hydraulic well control fluid reaching a particular value.

8. A method of pumping hydraulic well control fluid expelled from a control device of a well, the method comprising:

accumulating the hydraulic well control fluid;

using the pressure of hydraulic fluid supplied to the well to pump accumulated hydraulic well control fluid into a production flowline of the well;

sensing the pressure of accumulated expelled hydraulic well control fluid; and producing an indication which is used to increase the pressure of hydraulic fluid at the second inlet in response to the pressure of accumulated expelled hydraulic well control fluid reaching a particular value.

9. The method of claim 8, further comprising:

accumulating the control fluid in a cylinder arrangement, the cylinder arrangement comprising a piston, wherein the accumulated expelled hydraulic well control fluid acts at a first side of the piston to displace the piston in a first direction, and wherein the pressure of hydraulic fluid supplied to the well to pump accumulated expelled hydraulic well control fluid into a production flowline of the well applies pressure at a second side of the piston to pump accumulated expelled control fluid into said production flowline.

10. The method of claim 8, further comprising:

accumulating the control fluid in a first cylinder arrangement of a pump via a first inlet to the first cylinder arrangement, the first cylinder arrangement comprising:

a piston, wherein the expelled hydraulic well control fluid is accumulated on a first side of the piston;

a second inlet on a second side of the piston, the second inlet configured to receive hydraulic fluid supplied to the well;

an outlet on the first side of the piston in fluid communication with a production flowline of the well;

the pump further comprising a second cylinder arrangement positioned on the opposite side of the piston, the second cylinder arrangement containing hydraulic fluid and in fluid communication with the first cylinder arrangement, wherein the pressure of the expelled hydraulic well control fluid accumulated in the first cylinder arrangement displaces the piston in a direction towards the second cylinder arrangement.

11. The method of claim 10, further comprising:

receiving hydraulic fluid supplied to the well via the second inlet to the first cylinder arrangement on the second side of the piston, applying a pressure greater than the pressure of accumulated expelled well control fluid in the first cylinder arrangement in response to a displacement of the piston in a direction toward the second cylinder arrangement to displace the piston in a direction away from the second cylinder arrangement and to displace accumulated expelled well control fluid out of the first cylinder arrangement via the outlet.

12. The method of claim 10, wherein the pump further comprises:

a spool positioned between the piston and the second inlet; and a spring positioned in the second cylinder arrangement configured to urge the spool in the direction towards the second cylinder arrangement wherein hydraulic fluid at the second inlet acts on the spool so that if the pressure of hydraulic fluid at the second inlet is greater than the pressure of accumulated expelled well control fluid, the spool is displaced against the action of the spring to displace the piston in the direction away from the second cylinder arrangement.

13. The method of claim 8, wherein each of the first inlet and the outlet is provided with a one-way valve for permitting flow into and out of the first cylinder arrangement respectively.

14. The method of claim 8, wherein the second cylinder arrangement comprises:

a first cylinder in fluid communication with said first cylinder arrangement and a second cylinder in fluid communication with the first cylinder; and a second piston positioned in the second cylinder, wherein the expandable container is in fluid communication with the side of the second piston remote from the first cylinder.

15. The method of claim 8, wherein displacement of the hydraulic fluid is accommodated by an expandable container.

16. The pump according to claim 2, further comprising:

a second cylinder arrangement containing hydraulic fluid and in fluid communication with the cylinder arrangement on the opposite side of the piston, and a second inlet to the cylinder arrangement on an opposite side of the piston for receiving hydraulic fluid supplied to the well, there being an outlet from the cylinder arrangement on the first side of the piston for communicating with a production flowline of the well.

17. The pump according to claim 1, wherein the mechanism is a displacement mechanism and positioned between the piston and the second inlet.

18. The pump according to claim 1, further comprising an urging mechanism for urging the displacement mechanism in a direction towards the second cylinder arrangement, wherein the hydraulic fluid at the second inlet acts on the displacement mechanism so that if a pressure of hydraulic fluid at the second inlet is greater than a pressure of accumulated well control fluid, the displacement mechanism is displaced against the action of the displacement mechanism to displace the piston.

19. The pump according to claim 17, wherein the displacement mechanism comprises a spool received by the first cylinder arrangement between the piston and the second inlet.

20. The pump according to claim 18, wherein the urging mechanism comprises a spring mechanism disposed in the second cylinder arrangement.

* * * * *